United States Patent [19]

Gronau

[11] Patent Number: 4,850,087

[45] Date of Patent: Jul. 25, 1989

[54] WIRE-REMOVING MACHINE

[75] Inventor: Kurt Gronau, Euskirchen, Fed. Rep. of Germany

[73] Assignee: B&G-Fordertechnik GmbH, Euskirchen, Fed. Rep. of Germany

[21] Appl. No.: 162,084

[22] Filed: Feb. 29, 1988

[30] Foreign Application Priority Data

Mar. 12, 1987 [DE] Fed. Rep. of Germany ..... 3707966

[51] Int. Cl.[4] ..... B65B 69/00

[52] U.S. Cl. ..... 29/33 R; 29/426.4; 29/564.3; 83/909; 242/67.1 R; 242/75

[58] Field of Search ..... 83/78, 909; 130/1; 29/564.3, 426.4, 33 R; 242/75, 75.2, 78, 76, 67.1 R

[56] References Cited

U.S. PATENT DOCUMENTS 3,513,522 5/1970 Thomson ..... 83/909 X
3,685,759 8/1972 Adams et al. ..... 242/78
4,718,157 1/1988 Keyzers et al. ..... 83/909 X

FOREIGN PATENT DOCUMENTS 2816912 2/1979 Fed. Rep. of Germany .
2821336 10/1979 Fed. Rep. of Germany .
2101977 1/1983 United Kingdom ..... 242/78

*Primary Examiner*—Frank T. Yost
*Assistant Examiner*—Hien H. Phan
*Attorney, Agent, or Firm*—Brooks & Kushman

[57] ABSTRACT

A wire-removing machine for pulp bales consists of a positioning device (1) for the bales, a cutting device (2) for cutting through the tying wires stretched around the bales, and also a winding device (4) for winding the cut-through tying wires. In order to optimize the co-ordination between cutting and winding devices and so that cutting through and subsequently winding the wires can be carried out without problem even when the tying wires are arranged obliquely, a gripping device (3) is provided with which the tying wires are held in position and are lifted a short distance away from the bale after being cut through, the winding device (4) seizing the cut-through wires in the section between the bale and the gripping device (3) and winding them into coils.

10 Claims, 10 Drawing Sheets

WIRE-REMOVING MACHINE

Figure 1:
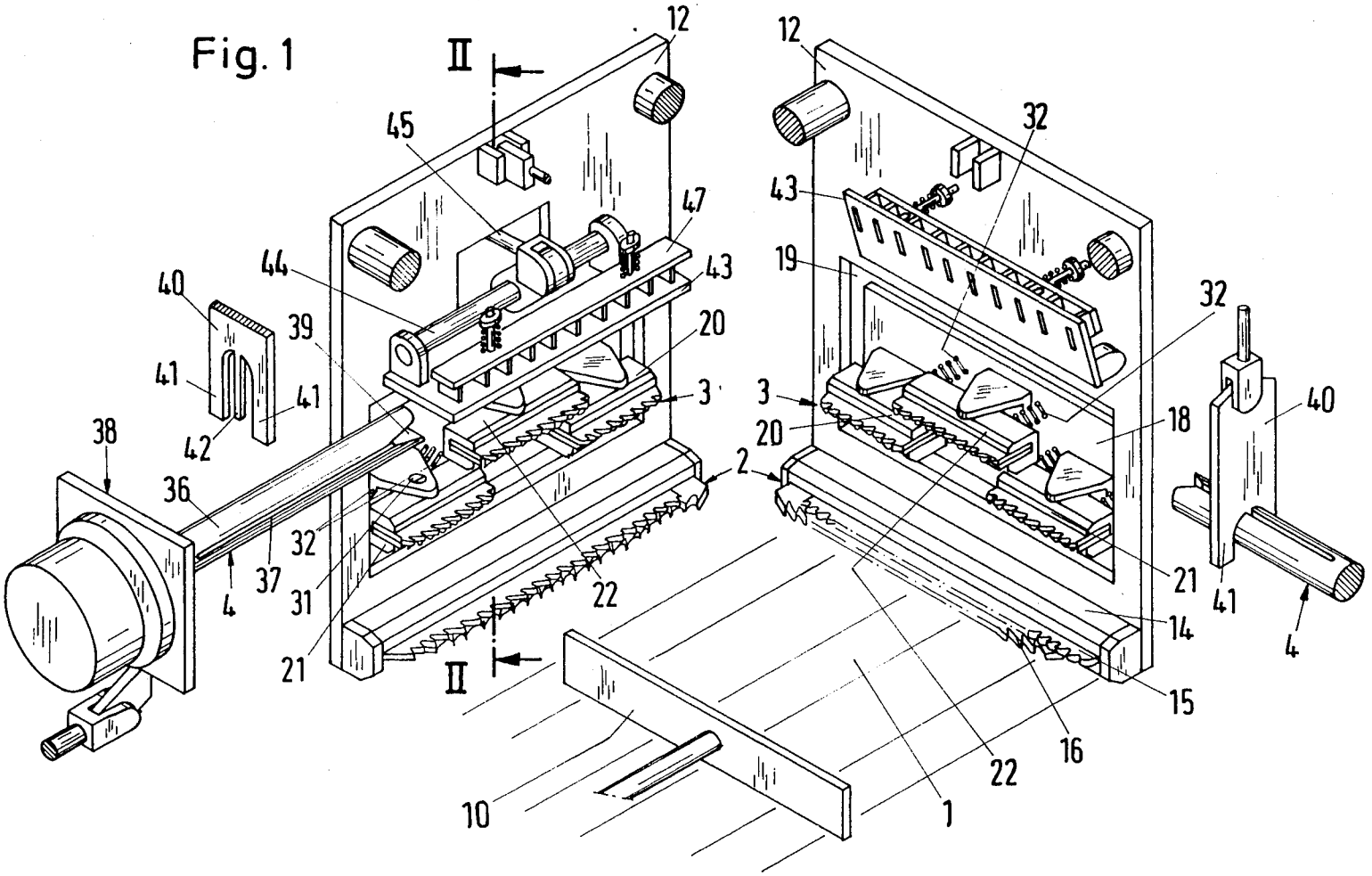

The invention relates to a wire-removing machine for bales, in particular for pulp bales, consisting of a positioning device for the bales, a cutting device for cutting through the tying wires stretched around the bales, and also a winding device for winding the cutthrough tying wires.

Cutting devices (German Patent Specification No. 2,816,912) and winding devices (German Patent Specification No. 2,821,336) for removing wire from bales have already been disclosed. The tying wires can easily be located and cut through with the known cutting devices, and the cutthrough tying wires can easily be wound with the known winding heads.

In the known devices, however, there is still a problem involving the co-ordination between the cutting devices and winding devices and also the locating of the cut-through wires by the winding devices.

The object of the invention is therefore to create a wire-removing machine in which the co-ordination between cutting and winding devices works better and cutting through and subsequently winding the wires can be carried out without problem even when tying wires are arranged obliquely.

According to the invention, this object is achieved in that a gripping device is provided with which the tying wires are held in position and after being cut through are lifted a short distance away from the bale and that the winding device seizes the cut-through wires in the section between the bale and the gripping device and winds them into coils.

On account of the construction according to the invention the cut-through tying wires, irrespective of whether they are arranged straight or oblique, are guided along a plane which extends obliquely downwards from the upper edge of the bale like the slope of a roof or which lies exactly in an extension of the upper side of the bale. The coiling device then only needs to be guided along this plane and as a result automatically encounters the corresponding wire sections, which can be reliably seized and wound into coils.

The gripping device is preferably formed by a lifting strip unit whose lifting strips lie parallel to the adjacent bale surface and are provided with teeth arranged so as to be distributed at equal intervals over their length, the flanks of which teeth, on the gripping side, are inclined obliquely from the tooth head towards the rear, forming an undercut. At the same time, the lifting strips are displaceable relative to one another in their longitudinal direction.

Moreover, the gripping device can be of a similar design to the cutting device according to German Patent Specification No. 2,816,912 but without cutting edges being made on the teeth. On account of the strip-shape, continuous gripping device, the wires are reliably seized, irrespective of their position, pulled some way into the teeth and then held in position.

A plurality of lifting strip units can be provided which are arranged next to one another, are offset vertically relative to one another, mutually overlap and are each pivotable about an axis running parallel to the wires. As a result of this measure, the lifting strip unit can also be adapted to a corrugated surface of the bales and can be reliably seize the tying wires. Normally, however, it is sufficient for a single lifting strip unit which extends over the entire width of a bale to be provided.

The winding device expediently has at least one fork-shaped receiver which is arranged between the bale and the respective gripping device, is guided in a longitudinally displaceably parallel to the bale and is rotatable about its longitudinal axis. Such a winding device can be of a very simple design, wherein only the fork-shaped receiver needs to be guided along the plane in which the cut-through tying wires are held.

The fork-shaped receiver can be a round-bar profile which at one end is situated in a rotatable mounting which is displaceable in the longitudinal direction of the profile, the slot extending from the opposite free profile end approximately over a bale length into the profile. In this way, two or more wires which lie in the described plane can be siezed with a single fork-shaped receiver, and can be easily wound up and removed from the receiver by means of a stripper.

In practice, the wires held by the gripper may not lie exactly in one plane. So that these tolerances can be compensated, the free slot end of the receiver can be widened.

So that the winding device produces wire coils which are as small as possible, a pressure plate can be provided which can be placed laterally against the fork-shaped receiver at least in the area of the wires to be wound. This ensures that the wires are wound closely on the receiver.

The pressure plate can be pivotable about an axis lying parallel to the fork-shaped receiver so that it can be gradually pivoted away from the receiver as the coil becomes larger.

Transverse webs are preferably arranged on the pressure plate at intervals, which transverse webs lie perpendicularly to the pressure plate, are displaceably mounted perpendicularly to the pressure plate on the side remote from the fork-shaped receiver and passed through slots in the pressure plate. In this arrangement, the transverse webs are used to limit the coil width so that consequently the coils are not only close but also narrow. If a transverse web encounters the wire to be wound when the pressure plate is placed against the receiver, the transverse web is pressed into the pressure plate so that this transverse web does not get in the way when the wires are being coiled. The transverse webs are preferably under spring pretension in the direction of the fork-shaped receiver so that no separate actuating mechanism is necessary for the transverse webs.

Alternatively, the winding device, instead of having the pressure plates, can also have a pressure roller which can be placed laterally against the fork-shaped receiver at least in the area of the wires to be wound and is under spring pretension in the direction of the fork shaped receiver. By means of the pressure roller, the coils to be wound can possibly be made even more compact.

Projecting guide pins which are arranged at intervals in both sides of the pressure roller in the area of the wires to be wound are preferably provided on the mounting of the pressure roller, which guide pins laterally overlap at a distance the pressure roller and fork-shaped receiver when the pressure roller rests against the latter. As a result of these guide pins, which in their two rows are arranged next to one another at relatively short intervals, the wires to be wound are guided approximately perpendicularly to the fork-shaped receiver so that there is no risk of the wires slipping out of the longitudinal slot at the start of the winding operation.

Figure 2:
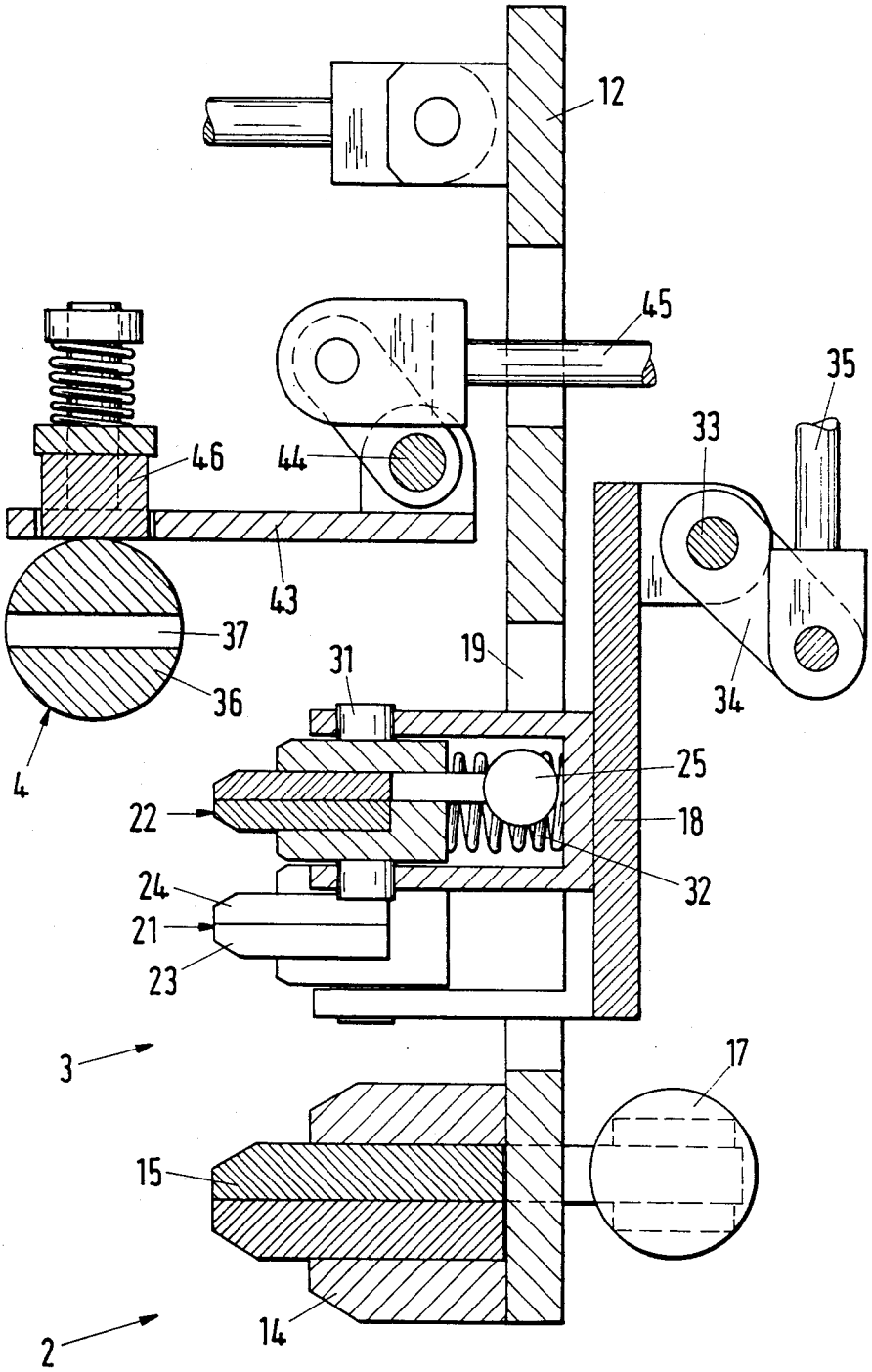
Figure 3:
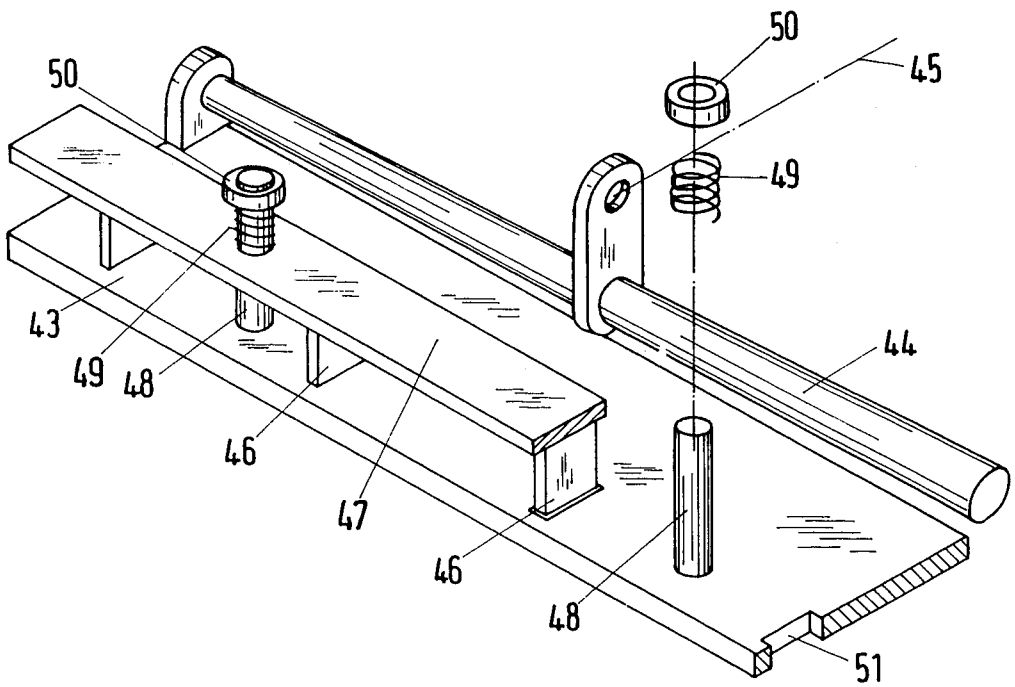
Figure 4:
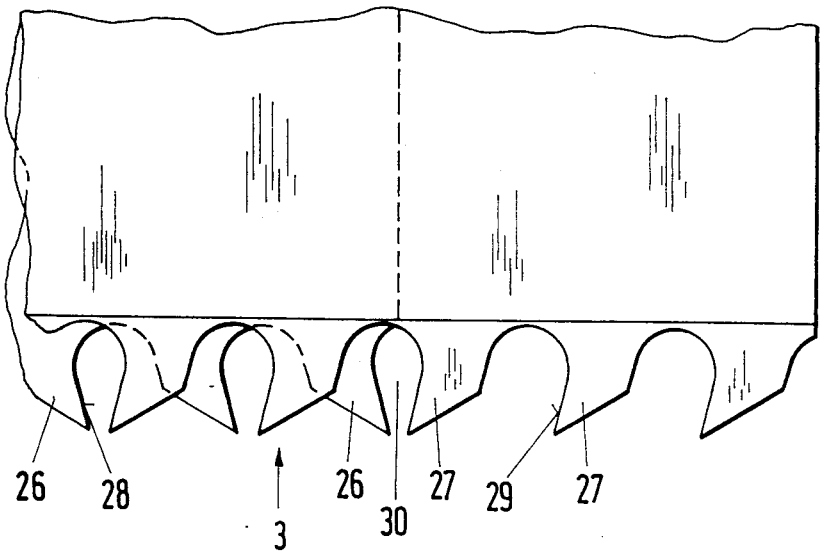
Figure 5:
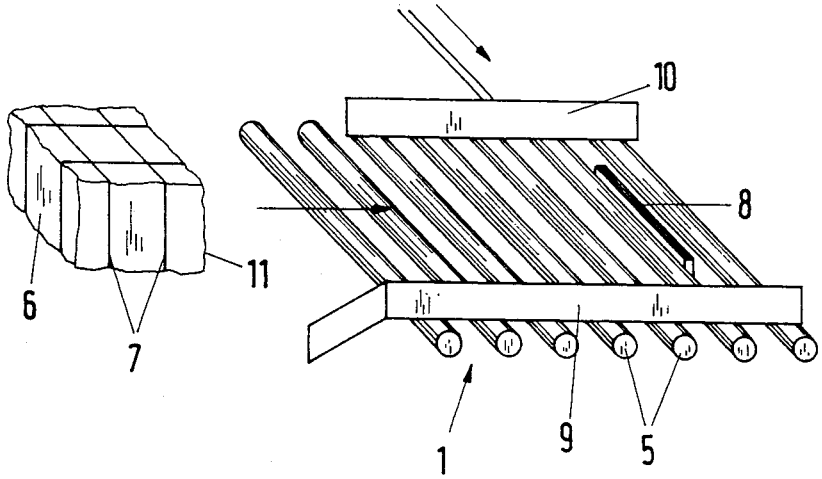
Figure 6:
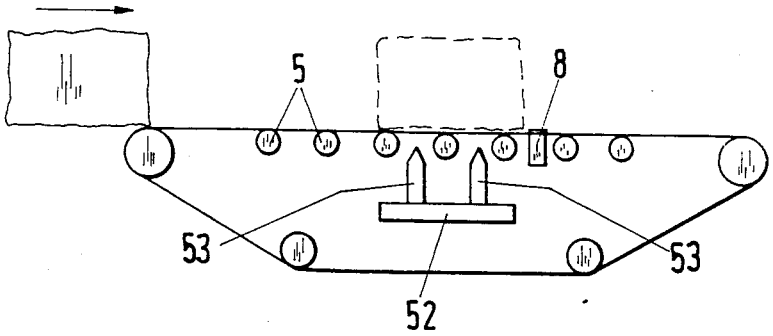
Figure 7:
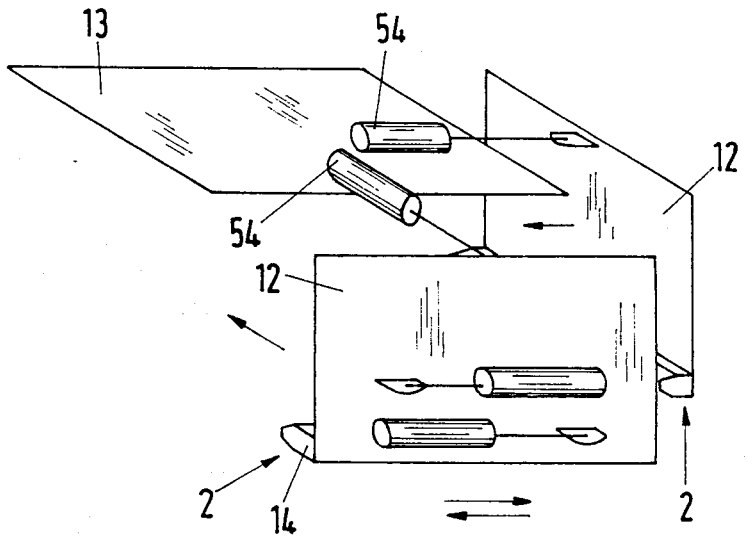
Figure 8:
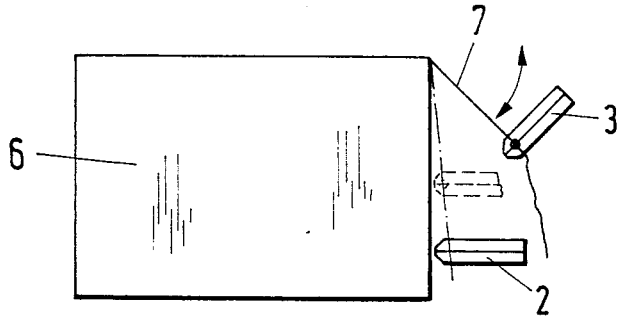
Figure 9:
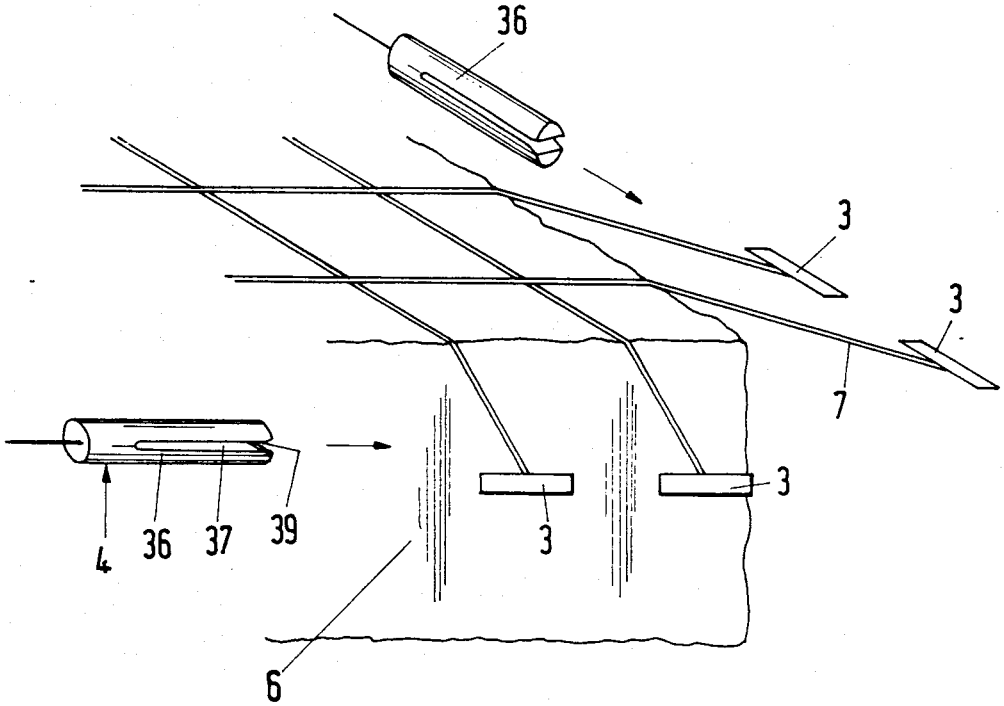
Figure 10:
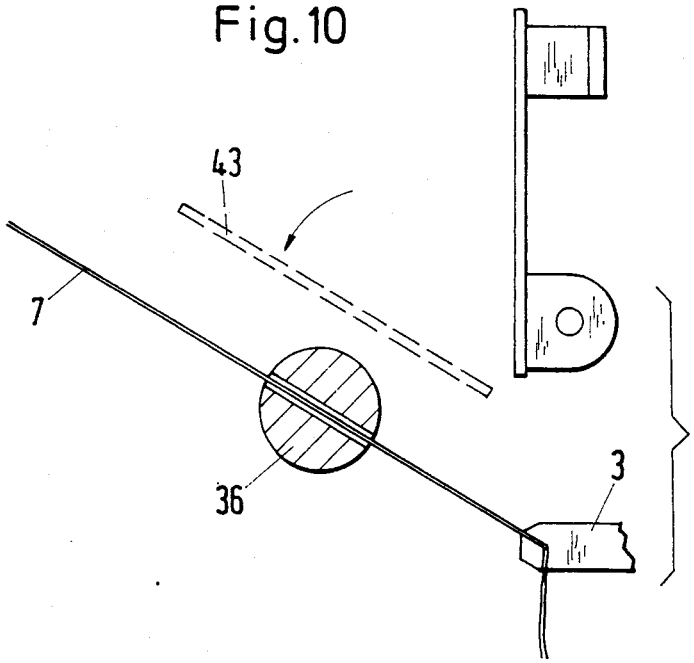
Figure 11:
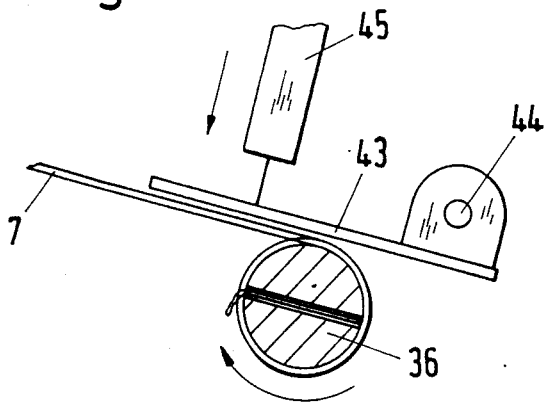
Figure 12:
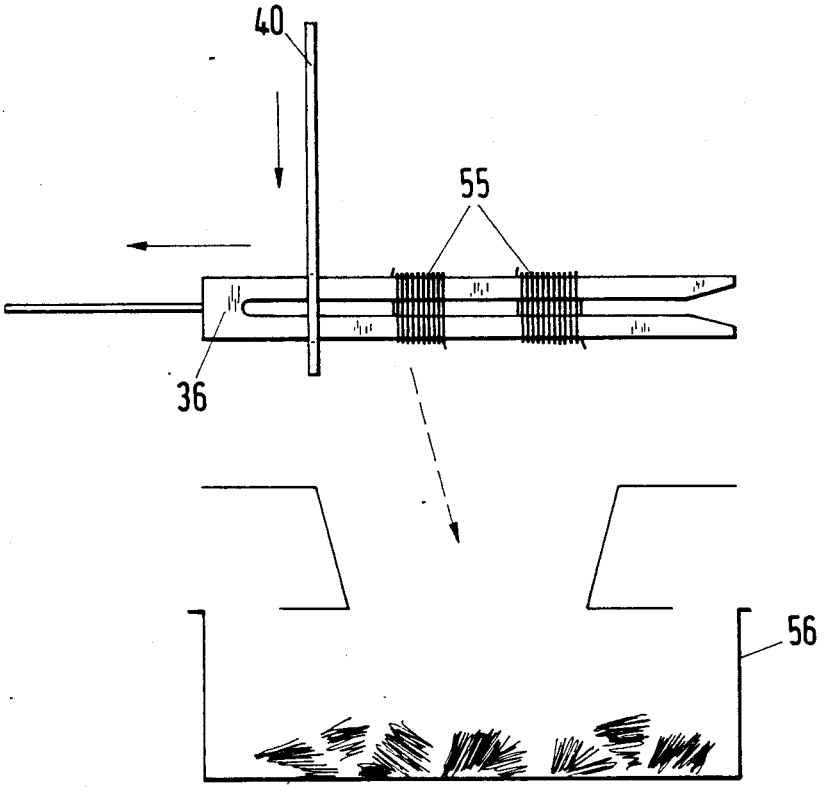
Figure 13:
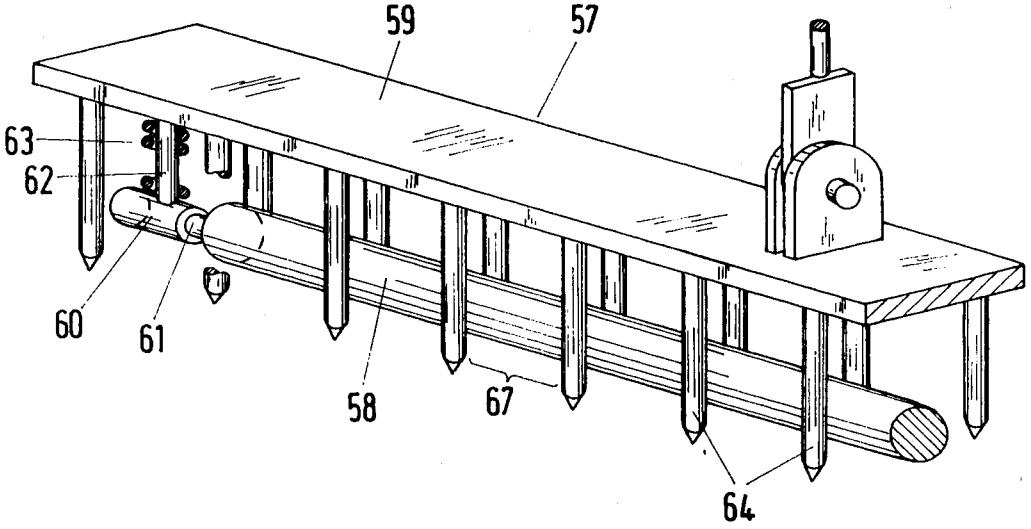
Figure 14:
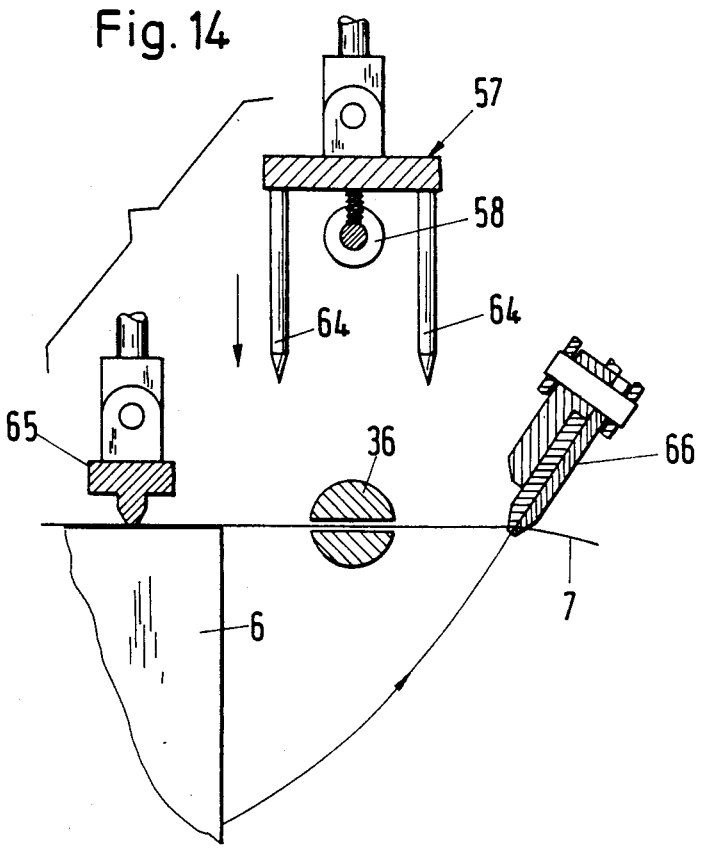
Figure 15:
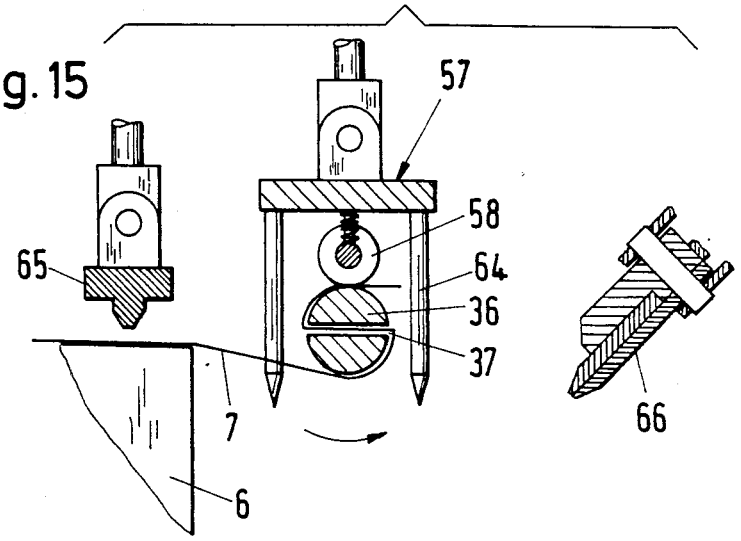

The invention is illustrated by way of example in the drawing, and is described below in detail with reference to the drawing, in which:

FIG. 1 shows a view of an exemplary embodiment of wire-removing machine in perspective representation, FIG. 2 shows an enlarged representation of a section along line II—II from FIG. 1, FIG. 3 shows a view of the pressure plate in perspective representation, FIG. 4 shows a detail of the gripping device in enlarged representation, FIG. 5 shows a schematic representation of a positioning device for the bales in the wire-removing machine, FIG. 6 shows a side view of the positioning device with a lifting device for lifting the bale, FIG. 7 shows a schematic view of the wire-removing machine in its working position, FIG. 8 shows a schematic representation of the gripping device in action, FIG. 9 shows a schematic representation of the winding device when the fork-shaped receiver is being advanced, FIG. 10 shows a schematic representation of a fork-shaped receiver directly before a cut-through tying wire is wound, FIG. 11 shows a fork-shaped receiver with a partially wound tying wire, FIG. 12 shows a fork-shaped receiver when the wound wire coils are being stripped, FIG. 13 shows the view of another embodiment of the pressing device, FIG. 14 shows the pressing device according to FIG. 13 directly before being placed onto the receiver, and FIG. 15 shows the pressing device in the mounted operating state.

According to FIGS. 1 to 4 of the drawing, the wire-removing machine, which is provided in particular for removing wire from pulp bales, substantially consists of a positioning device 1 for the bales, a cutting device 2 for cutting through the tying wires stretched around the bales, a gripping device 3 with which the tying wires can be held in place and pulled a short distance away from the bale after being cut through, and also a winding device 4 for winding the cut-through tying wires.

The cutting device 2, the gripping device 3 and also the winding device 4 are housed in a frame (not shown in greater detail in the drawing) with which the individual assemblies can be moved together vertically. The frame is located directly above the positioning device.

As follows from FIG. 5, the positioning device 1 substantially consists of a roller table 5 on which the bales 6, which are still provided with their tying wire 7 are advanced and positioned beneath the wire-removing machine. Used for positioning the bales is a limit switch 8, with which a particular bale 6 can be stopped on its transport path, and also a lateral guide strip 9 in combination with a slide 10 which is displaceable transversely to the roller table. When the bale has been stopped by actuating the limit switch 8 and has been pressed against the guide strip 9 by means of the slide 10, a vertical edge 11 of the bale 6 is in each case located in a certain position irrespective of size and height of the bale. The individual assemblies of the wire-removing machine are aligned with this edge 11. Alignment relative to one edge is sufficient, since the bales, as shown in FIG. 5, are held together by four tying wires 7 crossing in one plane. In this respect, two vertical wire sections arranged parallel to one another will occur in each vertical lateral surface of the bale 6, although they can run within relatively large tolerance ranges.

The cutting device 2, the gripping device 3 and also the winding device 4, which together are fixed on a frame (not shown in greater detail in the drawing) and can be moved in the horizontal and vertical direction, are orientated to the bale edge 11 aligned in each case by the positioning device 1.

The cutting device 2 and the gripping device 3 are fixed on plate-shaped mountings 12 which are arranged at right angles to one another, the plate-shaped mountings 12 each being arranged opposite those vertical lateral surfaces of the bales 6 which adjoin the aligned bale edge 11.

As can be recognised in particular from FIG. 7, the plate-shaped mountings 12 can be displaced forward and back relative to a frame plate 13, i.e. they can be moved towards a bale located in its aligned position and can be displaced back again from this bale.

As follows in particular from FIG. 1, a cutting device 2 is arranged in the lower area of each plate-shaped mounting 12. Moreover, the cutting device 2 can be of a similar design to the known cutting device according to German Patent Specification No. 2,816,912. Moreover, situated here in a housing-shaped mounting 14 are two elongated cutter bars 15 and 16, which on their cutting sides have teeth arranged one behind the other at regular intervals. One of the two cutter bars is fixed, while the other cutter bar can be pushed back and forth, namely by means of a lifting cylinder 17 which can be recognised in FIGS. 2 and 7 and is in each case arranged on the rear of the respective plate-shaped mounting 12.

As follows from FIGS. 1 and 2, each gripping device 3 sits on a pivotable plate 18 arranged behind the respective plate-shaped mounting, the gripping device 3 passing through a recess 19 in the respective plateshaped mounting 12. The gripping device 3 consists of three lifting strips 20, 21 and 22 which lie parallel to the cutting device 2 or the adjacent bale surface. The two outer lifting strip units 20 and 21 are arranged in alignment with one another, while the center lifting strip unit 22 lies slightly higher, the ends of the lifting strip units 20 and 22, and 22 and 21 respectively overlapping so that the entire bale surface area in which the tying wires can run is covered.

The lifting strip units 20 and 22 each consist of two lifting strips 23 and 24 displaceable relative to one another, of which the lower lifting strip 23 is fixed while the upper lifting strip 24 is displaceable by means of lifting cylinders 25. As can be recognised in particular from FIG. 4, the lifting strips 23 and 24 are provided with teeth 26 and 27 respectively which are arranged so as to be distributed at equal intervals over their length and whose flanks 28 and 29 respectively on the gripping side are inclined obliquely from the tooth head towards the rear so that an undercut 30 results. When the gripping flanks 28 and 29 of the teeth 26 and 27 respectively move towards one another, a wire seized by the teeth is pulled to rear into the undercut 30 and securely held there in place. The cutting device 2 can also be constructed according to a similar principle, although in this case the tooth flanks directed towards one another have to be provided with cutting edges in order to cut through the seized wires.

The three lifting strip units 20, 21 and 22 of the gripping unit 3 are each pivotably arranged about a central vertical axis 31, while the two lateral ends are supported against the pivotable plate 18 by means of compression springs 32. In this way, the lifting strip units can be reliably placed against the bale surfaces even if the latter are not flat.

The same principle of the split unit can also be applied to the cutting device 2 so that it too can adopt to any irregularities in the bale surface.

To pivot the plate 18, provided with the gripping device 3, relative to the plate-shaped mounting 12, the plate 18, in its upper area, is pivotably mounted about an axis 33 fixed relative to the plate-shaped mounting 12 and can be driven via a lever construction 34 by means of a lifting cylinder 35.

The winding devices 4, which are allocated to each gripping device 3, substantially consist of a fork-shaped receiver 36 which is formed from a round-bar profile provided with a central longitudinal slot 37. One end of the receiver 36 is situated in a rotatable mounting 38 which is displaceable in the longitudinal direction of the bar profile. The slot 37 extends from the free end of the profile approximately over a bale length into the round-bar profile. The free end of the slot 37 is provided with a wedge-shaped widened section 39 so that the wires are more easy to seize.

Alocated to each fork-shaped receiver 36 is a stripper 40 which is displaceable transversly to the respective receive 36 and laterally overlaps the latter with two legs 41. A central tongue 42 engages into the slot 37 so that the coiled wire ends can be reliably pulled off when the receivers 36 are displaced in the longitudinal direction relative to the strippers 40.

Allocated to each winding device 4 is a pressure plate 43 which is pivotable about an axis 44 running parallel to the respective receiver 36 and can be driven by means of a lifting cylinder 45. The plate 43 can in each case be placed obliquely from above onto the allocated receiver 36 in action.

As shown in particular in FIG. 3, transverse webs 46 are arranged at intervals on each pressure plate 43. The transverse webs are arranged perpendicularly to the pressure plate 43 and are displaceably mounted perpendicularly to the pressure plate 43 on the side remote from the fork-shaped receiver 36. Moreover, the transverse webs 46 are situated on a common retaining strip 47 which runs parallel to the pressure plate 43 and is displaceably guided on two bearing bolts 48. On its rear side, the retaining strip 47 is acted upon by a stressed compression spring 49 which is supported on a ring 50 situated on the bolt end.

The transverse webs 46, which extend through slots 51 in the pressure plate 43, rest against the outer surface of the fork-shaped receiver 36 when the pressure plate 43 is in an active position. In doing so, the transverse webs 46 limit the width of the coil to be wound.

The mode of operation of the wire-removing machine showed in the drawing is as follows:

The bale 6 arriving in FIG. 5 on the roller table 5 is stopped by means of the limit switch 8 and is pressed with the slide 10 against the guide strip 9 so that one corner, namely the bale edge 11, is always aligned, which is true irrespective of the dimensions of the particular bale.

As shown in FIG. 6, the bale 6 is located in this aligned position above a vertically displaceable table 52 which is provided with supporting pins 53 reaching upwards through the rollers of the roller table. By means of these supporting pins, the bale is lifted into a predetermined position in which the upper side of the bale always lies in the same plane and therefore always has the same position relative to the individual functional devices.

The frame together with the individual functional devices travels into the position shown in FIG. 7, and then the plate-shaped mountings 12 are moved towards the positioned bale by means of lifting cylinders 54, the cutting devices 2 striking the bale first and cutting through the particular tying wires 7.

The gripping devices 3 then seize the cut-through wires 7 and pivot into the oblique position shown in Fig. 8 in which the wires 7 lie in a plane directed obliquely downwards from the respective upper edge of the bale.

When the wires 7 have reached this position, the fork-shaped receivers 36 belonging to the winding device 4 travel forwards as illustrated in FIG. 9 and the wire ends are threaded into the longitudinal slot 37 of each receiver 36.

Once the fork-shaped receivers 36 have been advanced, the pressure plates 43 are lowered into their active position in which they come to lie close above the surface of the respective receiver.

Then, as shown in FIG. 11, the receivers 36 are set in rotation in order to wind the wires 7 into coils 55.

Once the pressure plates 43 have been swung back, the stripper 40 advances, as shown in FIG. 12, while at the same time the fork-shaped receivers 36 withdraw, as a result of which the coils 55 are stripped and fall into a receiving container 56.

Shown in FIG. 13 is another exemplary embodiment of a pressing device 57 which can be used as an alternative to the pressure plate 43 described above. The pressing device 57 is an essential component of the winding device 4 and has a pressure roller 58 which extends over the entire area of the wires to be wound. The pressure roller 58 is rotatably mounted on a plate-shaped mounting 59. Serving as bearings are two bearing sleeves 60 into which bearing pins 61 engage which are provided at the ends of the pressure roller 58.

The bearing sleeves 60 each sit on a guide rod 62 which is fixed perpendicularly on the plate-shaped mounting 59 and lies transversly to the axis of the pressure roller 58. The bearing sleeves 60 can either be displaceably mounted on the guide rods 62, or the guide rods 62 can be telescopically adjustable. In both exemplary embodiments, the bearing sleeves 60 are spring-loaded with the aid of compression springs 63 in a direction away from the plate-shaped mounting 59, i.e. the pressure roller 58 is under spring pretension in the direction of the fork-shaped receivers 36 so that the pressure roller, in the operating position, always rests with an approximately constant pressure against the wire coils being wound on the receiver 36.

Moreover, projecting guide pins 64 which are arranged at intervals on both sides of the pressure roller 58 in the area of the wires to be wound and which laterally overlap the pressure roller 58 at a distance are provided on the plate-shaped mounting 59. The free ends of the guide pins are pointed.

The functional mechanism of the pressing device 57 is illustrated in FIGS. 14 and 15.

Additionally provided in this exemplary embodiment is a holding-down strip 65 which presses from above onto the bale 6 and runs transversly to the tying wires 7 arranged approximately in parallel. Once the tying wires 7 have been cut through, the cut-through ends of the tying wires are lifted by means of the gripping device 3 until they lie approximately in a horizontal plane corresponding to the upper side of the respective bale 6. In this exemplary embodiment, the gripping device 3 consists of a single continuous lifting strip unit 66. When the tying wires 7 are lying in the common horizontal plane, the fork-shaped receiver 36, which is designed in the same way as the exemplary embodiment shown in FIGS. 1 to 12, advances. The free end of the receiver 36 can possibly be guided in an additional mounting (not shown in the drawing).

The pressing device 57 is then lowered from above until the pressure roller 58 rests on the receiver 36. The guide pins 64 at the same time overlap the receiver on both sides, i.e. the tying wires 7 to be coiled each lie in an intermediate space 67 between two guide pins 64 of a row of pins.

The fork-shaped receiver is then set in rotation, and at the same time the holding-down strip 65 and the lifting strip unit 66 are released so that they release the wire, as shown in FIG. 15. The wires 7 are then wound on the receiver 36 to form coils, the guide pins 64 ensuring, at least in the initial phase that the wire remains in the slot 37 of the receiver 36 and does not slip out of the latter at the side. The pressure roller 58 helps to wind the wires 7 into compact coils. The coils are then stripped from the receiver 36 in the same as in the example shown in FIG. 12 and fall into the receiving container 56.

List of reference numerals

1. Positioning device
2. Cutting device
3. Gripping device
4. Winding device
5. Roller table
6. Bale
7. Tying wires
8. Limit switch
9. Guide strip
10. Slide
11. Aligned bale edge
12. Plate-shaped mounting
13. Frame plate
14. Housing-shaped mounting
15. Cutter bar
16. Cutter bar
17. Lifting cylinder
18. Pivotable plate
19. Recess
20. Lifting strip unit
21. Lifting strip unit
22. Lifting strip unit
23. Fixed lifting strip
24. Displaceable lifting strip
25. Lifting cylinder
26. Teeth
27. Teeth
28. Flanks
29. Flanks
30. Undercut
31. Vertical axis
32. Compression springs
33. Axis
34. Lever construction
35. Lifting cylinder
36. Fork-shaped receiver
37. Longitudinal slot
38. Mounting
39. Widened section
40. Stripper
41. Leg
42. Tongue
43. Pressure plate
44. Pivot axis
45. Lifting cylinder
46. Transverse webs
47. Retaining strip
48. Bearing bolt
49. Compression spring
50. Ring
51. Slots
52. Table
53. Supporting pins
54. Lifting cylinder
55. Coils
56. Receiving container
57. Pressure device
58. Pressure roller
59. Plate-shaped mounting
60. Bearing sleeve
61. Bearing pins
62. Guide rod
63. Compression spring
64. Guide pins
65. Holding-down strip
66. Lifting strip unit
67. Intermediate space

I claim:

1. Wire-removing machine for bales, such as pulp bales having tying wires stretched around the bales, the machine comprising a positioning device for positioning a bale, a cutting device for cutting through the tying wires, a gripping device for lifting the tying wires away from the bale after being cut through, and a winding device for winding the cut-through tying wires, the machine being characterized in that the cutting device includes two elongated cutter bars having cutting sides provided with teeth arranged one behind the other at regular intervals, the bars being movable back and forth relative to each other, wherein the gripping device is formed by at least one lifting strip unit including lifting strips provided with teeth arranged so as to be distributed at equal intervals over the length of the lifting strips, the lifting strips lying parallel to an adjacent bale surface of a positioned bale and being displaceable relative to one another in their longitudinal direction, and wherein the winding device seizes the cut-through wires in an area between the bale and the gripping device and winds the cut-through wires into coils.

2. The wire-removing machine according to claim 1, characterized in that the teeth of the gripping device are provided with tooth heads and flanks, each of the flanks having a gripping side inclined obliquely rearwardly from its tooth head to form an undercut.

3. The wire-removing machine according to claim 1 wherein the winding device (4) has at least one fork-shaped receiver (36) which is arranged in the area between the bale (6) and the respective gripping device (3), is guided in a longitudinally displaceable manner parallel to the lifting strips (20, 21, 22) and is rotatable about its longitudinal axis.

4. The wire-removing machine according to claim 3, wherein the fork-shaped receiver (36) includes a round-bar profile having first and second ends and a central longitudinal slot (37) extending from the first end approximately over a bale length into the profile, the second end being situated in a rotatable mounting (38) which is displaceable in the longitudinal direction of the profile.

5. The wire-removing machine according to claim 4, wherein the first end has a widened section (39).

6. The wire-removing machine according to claim 3, wherein the winding device (4) has a pressure plate (40) movable to a lateral position adjacent the fork-shaped receiver (36) to assist in winding the cut-through wires.

7. The wire-removing machine according to claim 6, wherein the pressure plate (43) is pivotable about an axis (44) lying parallel to the fork-shaped receiver (36).

8. The wire-removing machine according to claim 6, wherein transverse webs (46) are arranged on the pressure plate (43) at intervals, which transverse webs (46) lie perpendicularly to the pressure plate (43) are displaceably mounted perpendicularly to the pressure plate (43) on the side remote from the fork-shaped receiver (36) and pass through slots (51) in the pressure plate (43).

9. The wire-removing machine according to claim 3, wherein the winding device (4) has a pressure roller (58) movable to a lateral position adjacent the fork-shaped receiver (36) to assist in winding the cut-through wires wherein the roller is under spring pretension (63) in a direction towards the fork-shaped receiver (36).

10. The wire-removing machine according to claim 9, wherein projecting guide pins (64) which are arranged at intervals on both sides of the pressure roller (58) in the area of the wires (7) to be wound are provided on the mounting (59) of the pressure roller (58), which guide pins (64) laterally overlap at a distance the pressure roller (58) and the fork-shaped receiver (36) when the pressure roller (58) rests against the latter.

* * * * *